US006991886B2

(12) United States Patent
Earley et al.

(10) Patent No.: US 6,991,886 B2
(45) Date of Patent: Jan. 31, 2006

(54) CLOSED AIR CIRCULATION TONER ROUNDING

(75) Inventors: John Joseph Earley, Boulder, CO (US); George Pharris Marshall, Boulder, CO (US); John Melvin Olson, Boulder, CO (US); Trent Duane Peter, Johnstown, CO (US); Minerva Piffarerio, Erie, CO (US); Vincent Wen-Hwa Ting, Boulder, CO (US); Ronald James Whildin, Boulder, CO (US)

(73) Assignee: Lexmark International, Inc., Lexington, KY (US)

( * ) Notice: Subject to any disclaimer, the term of this patent is extended or adjusted under 35 U.S.C. 154(b) by 61 days.

(21) Appl. No.: 10/862,871

(22) Filed: Jun. 7, 2004

(65) Prior Publication Data

US 2005/0255401 A1 Nov. 17, 2005

Related U.S. Application Data

(63) Continuation-in-part of application No. 10/846,200, filed on May 14, 2004, now abandoned.

(51) Int. Cl.
*G03G 13/14* (2006.01)

(52) U.S. Cl. ..... 430/137.1; 430/137.16; 430/110.3

(58) Field of Classification Search ..... 430/137.1, 430/137.16, 110.3
See application file for complete search history.

(56) References Cited

U.S. PATENT DOCUMENTS

| | | | | |
|---|---|---|---|---|
| 3,449,291 | A | 6/1969 | Lerman et al. | |
| 3,586,654 | A | 6/1971 | Lerman et al. | |
| 3,669,922 | A | 6/1972 | Bartsch et al. | |
| 3,674,736 | A | 7/1972 | Lerman et al. | |
| 4,746,590 | A | 5/1988 | Kasai et al. | |
| 5,981,129 | A | 11/1999 | Akazawa et al. | |
| 6,022,661 | A | 2/2000 | Kurose et al. | |
| 6,106,990 | A * | 8/2000 | Tazawa et al. | 430/137.19 |
| 6,214,511 | B1 | 4/2001 | Akazawa et al. | |
| 6,335,138 | B1 | 1/2002 | Kurose et al. | |
| 6,383,706 | B1 | 5/2002 | Kumar et al. | |
| 6,582,866 | B2 | 6/2003 | Kumar et al. | |
| 6,586,150 | B2 | 7/2003 | Proper | |
| 6,586,151 | B1 | 7/2003 | Naka et al. | |
| 2002/0076639 | A1 | 6/2002 | Uno et al. | |
| 2003/0049559 | A1 | 3/2003 | Shigemori et al. | |
| 2003/0077536 | A1 | 4/2003 | Yamashita et al. | |
| 2003/0096181 | A1 | 5/2003 | Kumar et al. | |

OTHER PUBLICATIONS

Nara Machinery Co., Ltd, Hybridization System, —Product literature, 7 pages.

* cited by examiner

*Primary Examiner*—Mark A. Chapman
(74) *Attorney, Agent, or Firm*—John A. Brady

(57) ABSTRACT

Toner is rounded by vigorously mixing less than about 5 percent by weight of particulate silica to the total weight of a starting toner in a closed, recirculating air system. The starting toner contains at least about 4.5 percent by weight of the starting toner of a wax and additionally contains at least 5 percent by weight of the starting toner of a softening agent. The temperature during the mixing is no more than 13 degrees C. above the onset of the glass transition temperature of the starting toner. The final toner comprises rounded starting toner having particulate silica embedded during the mixing process.

20 Claims, No Drawings

CLOSED AIR CIRCULATION TONER ROUNDING

RELATED APPLICATION

This is a continuation-in-part of an application of the same title, filed May 14, 2004, having Ser. No. 10/846,200 now ABN.

TECHNICAL FIELD

This invention relates to the manufacture of dry, particulate electrophotographic toner by rounding of the toner particles.

BACKGROUND OF THE INVENTION

It is desirous to produce rounded toner particles, regardless of manufacturing origin, for a variety of reasons. The smoother surface affords fewer points of contact between toner and other surfaces in general, thus facilitating the removal of toner therefrom. As the trend to smaller and smaller toner sizes has occurred, the fundamental limitation of non-rounded toner is that it is difficult to convey in all regards. This is particularly critical in the development and transfer steps, from which much of the print quality is derived.

While chemically prepared toner (toner prepared in situ in liquid) offers the advantage of a rounder or smoother toner surface than conventional toner, a degree of smoothness and or circularity is not always necessary to capture the benefits of development and transfer. Smaller size in itself advances the level of print quality, all other considerations fixed. However, the complication of surface adhesion dramatically limits the efficiencies of development and transfer, thus offsetting the perceived advantage of reduced size. The introduction of the rounded surface overcomes these limitations, and enables both development and transfer to be optimized without reservation. Absent this shape advantage, transfer of toner less than 8 microns in size is particularly handicapped due to the ionization of air (field breakdown) which nearly always occurs prior to the attainment of optimal transfer.

The open and patent literature is full of references for the rounding of fractured toners, and there are a variety of ways in which this has been done. There is mechanical milling, actually just modified jet milling, in which the particles are rounded during the milling operation. The toner particles may be suspended in a hot air stream and rounded in that fashion. Other rounding devices utilize air bearings, wherein an air stream is forced through the device continuously in order to prevent particles from interfering with the motion of the stirring assembly and to create a fluidized bed; this requires an outlet to atmosphere though which the air flow may be vented.

The CYCLOMIX commercial mixing device (product of Hosokawa) creates a recirculating air stream surrounded by a heating/cooling jacket. This invention employs in its current implementation such a mixing device. Rounding occurs during repeated collisions with other particles and with the blade/vessel wall.

Since such mixing is very vigorous, particulate silica is included with the toner to prevent agglomeration of the toner during the mixing. This results in significant particulate silica being embedded in the rounded toner particles which further results in increased viscosity of the toner, thereby destroying adequate toner function for standard toner.

DISCLOSURE OF THE INVENTION

This invention recognizes that modification of the toner ingredients and control of temperature during vigorous air recirculation produces well functioning, rounded electrophotographic toner.

This invention employs about 3.5 to about 5 percent by weight of particulate silica to the total weight of the starting toner and silica. The starting toner contains at least 4.5 percent by weight of the starting toner of a wax and also contains at least 5 percent by weight of the starting toner of a softening agent. In an embodiment, the temperature during the vigorous air circulation is no more than 13 degrees C. above the onset of the glass transition temperature (Tg) of the starting toner.

The final toner comprises the starting toner having particulate silica embedded during the mixing process.

DESCRIPTION OF THE PREFERRED EMBODIMENTS

The CYCLOMIX mixing device resembles a suspended cone, with the tip of the cone pointed downward. The vessel consists of the body (cone) plus an associated lid with a stirring mechanism and associated bearing (mechanical seal). The mixing paddle assembly is also conical in shape, consists of a series of spaced, increasingly wider blades extending to near the side of the cone that serve to agitate the entire contents of the cone-shaped container as they are swept around the walls of the vessel. Shear is generated through the zones established by the blade edges and the vessel wall.

Since the sides of the cone present a surface facing upward, the materials are deflected upward, where they encounter the top of the cone at it widest part, move toward the center of the cone and then move downward, thereby recirculating.

The CYCLOMIX mixing device is mechanically sealed from its surroundings and therefore does not operate with an active air stream passing through the vessel. The mixing system is a closed system, with very vigorous and energetic stirring of the vessel contents which serves to keep said contents suspended and in constant motion.

The mixing device is also equipped with a heating/cooling jacket, which allows for the contents of the vessel to be heated in a controlled manner to a pre-determined value. Heat transfer occurs from the circulating heating medium through the steel walls of the cone-shaped body and heat is passed into the constantly stirred particulate material contained within the cone-shaped chamber Unlike other rounding processes which depend upon surface tensions of a solvent dispersion or a particulated melt dispersion, this mixing process is executed in the absence of any added solvent. Toner, prepared in any conventional process, serves as the starting material for the typical rounding operation. The toner material to be modified is charged into the mixing chamber along with an extra particulate additive, the function of which being to keep the discrete particles separated during the rounding operation. In a best mode, typically a kilo of 7 micron toner powder is added to the 5 liter reactor at ambient temperature with up to about 5 weight % hydrophobic fumed silica to the weight of the combined starting toner and the silica.

The room-temperature mixture of toner and silica is vigorously stirred to create an intimate mixture of toner particles encapsulated or coated with silica. The temperature of the contents rises gradually with the temperature of the heat applied to the jacket, and eventually the temperature of the particulate toner approaches the glass transition onset temperature of the polymer matrix. At this temperature, the transition from a brittle, glassy solid to a deformable thermoplastic occurs. It is imperative that the temperature be adjusted such that particle deformability is enabled, but not so excessively that rampant melting and agglomeration of the contents occurs. The temperature may not be above about 13 degrees C. more than onset of the glass transition temperature of the starting toner, in the case of a 5 liter reactor.

The function of the added silica is to prevent particles from associating with one another during the rounding operation; rounding occurs through collisions with the vessel stirring mechanism, walls and other toner particles. Extended residence times at temperature in the reactor produce increased particle sphericity.

At the conclusion of the rounding operation, the contents are cooled and discharged. The toner particle surface has been impregnated with the silica added at the initiation of the rounding operation, and no longer resembles the simple mixture initially obtained.

The use of this rounding technique allows for the compensation of the non-rounded shape limitation at development and transfer. In this toner treatment, conventionally fractured toner is rendered rounder and more spherical in contour and outline. This is accomplished by heating the toner to a temperature above the glass transition, whereby the material changes from a glassy state to a malleable, flexible one with somewhat irreversible flow characteristics. Maintained in a vigorously stirred state, the mechanical impacts at temperature transform the rough, jagged edges of the particles to create a smoother, rounded surface. In order to accomplish this shape modification, preserve the size distribution and preclude agglomeration of particles as their adhesivity increases, substantial amounts of silica are admixed with the toner prior to the rounding operation. As a consequence of the amount of silica required to effect this toner transformation, fusibility is compromised absent revision of the toner composition and limitation of the amount of silica.

It is not entirely clear why the toner fusibility is destroyed during the rounding process. It is speculated that the large amount of silica present serves as a viscosity builder which prevents the required melt deformation and viscous flow from occurring during fusing. Subsequently, toner may not be forced into the interstices of a paper being imaged and a firm mechanical bond between the two is not created.

Presuming that the resistance to melt flow is provided by the large amounts of silica present, initiatives which serve to decrease toner melt viscosity should facilitate fusing.

All toners of the following three Tables 1, 2, and 3 employ the same ingredients listed in Table 1, except the PETB is not in the conventional toner of Table 2. The starting toners of Tables 1, 2, and 3 are prepared by conventional mastication of the ingredients. Accordingly, the final particles after mastication and milling are jagged and have shape factors (the difference in long and short diameters) in the 80's.

A currently preferred formulation of the starting toner of this invention is described in the following Table 1.

TABLE 1

| Material | Material % by Weight | Material Description |
|---|---|---|
| Resin NE 701 | 44.6 | Lightly crosslinked polyester resin manaufactured by Kao - Binder resin. |
| Resin LLT-113 | 25.6 | Liner polyester resin manufactured by Kao - Binder resin |
| Additive: PETB | 5 | Pentaerythritol tetrabenzoate |
| Masterbatch: Hostacopy E02 M106 (5.4%) | 13.5 | Masterbatch of PR 122 (product of Clariant Corp, 40%) in ER-561 resin (Kao). Total pigment content is 5.4%. |
| Wax: S&P Carnauba #63 | 3.75 | Carnauba wax (product of Strahl & Pitsch) |
| Wax: NOF WE-5 | 3.75 | Synthetic ester wax (Nippon Oil & Fat) |
| RY50 | 2.00 | Hydrophobic large silica (Degussa) |
| A380 | 1.00 | Hydrophobic small silica (Degussa) |
| DL-N31 | 0.25 | Zinc salicylate CCA (Hubei Ding Long) |
| Hostacopy N4P | 0.50 | Non-metallic CCA (Clariant) |
| Total | 100.00 | |

An exemplary conventional toner formulation having good fusing behavior is its jagged form is shown in the following Table 2.

TABLE 2

| Material | Function | Percent by Weight |
|---|---|---|
| NE-701 (Kao) | Binder resin | 51.75 |
| LLT-113 (Kao) | Binder resin | 29.75 |
| Hostacopy E02-M106 (Clariant) | Pigment Red 122 Masterbatch | 11.25 |
| WE-5 wax (Nippon Oil & Fat) | Internal release agent | 1.75 |
| Carnauba wax (Strahl & Pitsch) | Internal release agent | 1.75 |
| Hostacopy N4P (Clariant) | CCA | 0.50 |
| DL-N31 (Hubei Dinglong) | CCA | 0.25 |
| RY-50 (Degussa) | Filler | 2 |
| A-380 (Degussa) | Filler | 1 |
| | | 100 |

After mechanical grinding to a median size of 9 micron, the toner of Table 2 is finished by applying extraparticulates to improve flow characteristics in a conventional fashion and demonstrates adequate fusibility (adhesion to paper) at an acceptable temperature.

This toner of Table 2 does not afford minimal torque resistance in an EP cartridge, nor does it demonstrate adequate transfer characteristics due to the toner particle shape. In an attempt to render the toner particle shape more spherical and rounded, the above powder is physically mixed with 5% of a fumed silica of about 30 nanometers average primary particle size (in the embodiment NY-50 fumed silica from Degussa, average primary particle size of 30 nanometers) and subjected to the rounding process. Now, although the toner glass transition and melt flow temperatures are unchanged, the apparent melt viscosity of the toner has increased dramatically, such that the toner is only partially fusible. While it may fuse to paper at 100% coverage at a delta of an additional 20 degrees, it is totally non-fusible at the nominal 230% coverage simulating full color development.

If the toner formulation in Table 2 is modified, some improvement may be noted. Increasing the combined wax level from 3.5 to 4.5% improves the fusibility marginally after the toner is rounded.

Materials known as softening agents are added to toner formulations to increase fusibility. A softening agent is consistent with and similar to a plasticizer in that it separates from binder resin and is more pliable than the binder resin. One such material is pentaerythritol tetrabenzoate (PETB). The toner formulation of Table 3 contains this softening agent PETB:

TABLE 3

| Material | Function | Percent |
|---|---|---|
| NE-701 (Kao) | Binder resin | 48.6 |
| LLT-113 (Kao) | Binder resin | 27.9 |
| Pentaerythritol tetrabenzoate (PETB) | Softening agent | 5% |
| Hostacopy E02-M106 (Clariant) | Pigment Red 122 Masterbatch | 11.25 |
| WE-5 wax (Nippon Oil & Fat) | Internal release agent | 1.75 |
| Carnauba wax (Strahl & Pitsch) | Internal release agent | 1.75 |
| Hostacopy N4P (Clariant) | CCA | 0.50 |
| DL-N31 (Hubei Dinglong) | CCA | 0.25 |
| RY-50 (Degussa) | Filler | 2 |
| A-380 (Degussa) | Filler | 1 |

After conventional preparation of the corresponding powder and rounding with the 5% NY-50 silica, this toner is also found to afford only a modest improvement in fusibility. However, the two different variables in formulation (wax level and softening agent) may be combined in a conventional powder as shown in Table 1:

Upon rounding of a starting toner of Table 1, which combines the added softening agent with increased level of wax, it is found that fusibility is restored. The unanticipated result is that the combination of wax and softening agent is unexpectedly greater than the sum of their individually demonstrated effects The rounding operation applied to the formula of Table 1 is as follows.

1) 4% by weight of the NY-50 silica and toner of Table 1 are added to the CYCLOMIX mixer (1000 g toner+40 g NY-50) and mixed together at high speed prior to warming. Heaters are started and heating medium in jacket warms vessel. The silica has a primary particle size of 30 nanometers.
2) Temperature of the mixer is held 30 minutes while operating the mixer and heating the mixture to 64 degrees C. The 30 minutes begins at 51 degrees C. (the glass transition temperature onset of the toner formula) and then is held at 64 degrees C. when 64 degrees C. is reached. Thus, the primary heating is at 13 degrees above the glass transition temperature onset.
3) When temperature reaches 50 degrees C., power mixture at speed above the rounding speed for 30 seconds the break up loose agglomerates.
4) This rounded toner fuses virtually identically to the toner of Table 2, the unmodified control
5) Resulting characteristics as compared to a control toner to Table 2 are as follows.

| Toner | % PETB | % Wax Package | % Silica, Surface | Shape | Shape Factor |
|---|---|---|---|---|---|
| Control | 0 | 3.5% | 0 | Irregular, fractured | 0.88 |
| Table 1 Toner | 5% | 6.5% | 4 | Rounded | 0.95 |

The foregoing rounded Toner of Table 1 shows the following properties when tested with 16# paper in a full color fuser.

| Toner | Surface silica | Shape | Fusubility |
|---|---|---|---|
| Control | 0% | Irregular | Good |
| Rounded, without modification | 4% | Rounded | Poor |
| Rounded, with modification (Table 1 Toner) | 4% | Rounded | Good |

Similalrly the toner shows the following minimum and maximum temperatures for adhesion (T is temperature in degrees C.).

| Toner | Min T for Adhesion | Max T for Release | Window |
|---|---|---|---|
| Control | 125 | 185 | 60 |
| Rounded, without modification | 185+ | 185+ | 0 |
| Table 1 Toner | 125 | 180 | 55 |

It is apparent that a wide range of variations in formulation, temperatures and processing times and speeds are consistent with this invention, particularly as starting toner formulation may vary considerable with respect to the primary binder resin.

The invention claimed is:

1. The method of rounding electrostatic toner comprising vigorously mixing in a closed, recirculating air system a mixture of about 96.5 percent or more by weight starting toner and between about 3.5 and 5 percent by weight particulate silica, said starting toner having by weight of said starting toner at least 4.5 percent by weight wax and at least 2 percent by weight softening agent.

2. The method of claim 1 in which the temperature during said vigorous mixing in no more than 13 degrees C. above the onset of the glass transition temperature of said starting toner.

3. The method as in claim 2 in which said softening agent is pentaerythritol tetrabenzoate.

4. The method as in claim 1 in which said particulate silica has an average primary particle size of about 30 nanometers.

5. The method as in claim 4 in which said silica is about 4 percent by weight of the weight of said starting toner.

6. The method as in claim 5 in which said softening agent is about 5 percent by weight of the weight of said starting toner.

7. The method as in claim 6 in which said softening agent is pentaerythritol tetrabenzoate.

8. The method of claim 6 in which the temperature during said vigorous mixing in no more than 13 degrees C. above the onset of the glass transition temperature of said starting toner.

9. The method as in claim 8 in which said softening agent is pentaerythritol tetrabenzoate.

10. The method as in claim 5 in which said softening agent is pentaerythritol tetrabenzoate.

11. The method as in claim 4 in which said softening agent is about 5 percent by weight of the weight of said starting toner.

12. The method as in claim 11 in which said softening agent is pentaerythritol tetrabenzoate.

13. The method as in claim 4 in which said softening agent is pentaerythritol tetrabenzoate.

14. The method as in claim 1 in which said silica is about 4 percent by weight of the weight of said starting toner.

15. The method as in claim 14 in which said softening agent is about 5 percent by weight of the weight of said starting toner.

16. The method as in claim 14 in which said softening agent is pentaerythritol tetrabenzoate. The method as in claim 1 in which said softening agent is pentaerythritol tetrabenzoate.

17. The method as in claim 15 in which said softening agent is pentaerythritol tetrabenzoate.

18. The method as in claim 1 in which said softening agent is about 5 percent by weight of the weight of said starting toner.

19. The method as in claim 18 in which said softening agent is pentaerythritol tetrabenzoate.

20. The method as in claim 1 in which said softening agent is pentaerythritol tetrabenzoate.

* * * * *